US009403080B2

(12) United States Patent
Jean et al.

(10) Patent No.: US 9,403,080 B2
(45) Date of Patent: Aug. 2, 2016

(54) SPORT HELMET COMPRISING AN OCCIPITAL INNER PAD MOUNTED TO A MOVABLE REAR SUPPORT

(71) Applicant: BAUER HOCKEY CORP., St-Jerome (CA)

(72) Inventors: Philippe Jean, Terrebonne (CA); Jacques Durocher, St-Jerome (CA); Marie-Claude Genereux, Ste-Therese (CA); Denis Cote, St-Colomban (CA)

(73) Assignee: BAUER HOCKEY, INC., Exeter, NH (US)

( * ) Notice: Subject to any disclaimer, the term of this patent is extended or adjusted under 35 U.S.C. 154(b) by 126 days.

(21) Appl. No.: 14/041,390

(22) Filed: Sep. 30, 2013

(65) Prior Publication Data

US 2015/0089723 A1 Apr. 2, 2015

(51) Int. Cl.

| | |
|---|---|
| ***A42B 1/22*** | (2006.01) |
| ***A63B 71/10*** | (2006.01) |
| ***A42B 3/08*** | (2006.01) |

(52) U.S. Cl.

CPC ..... *A63B 71/10* (2013.01); *A42B 3/085* (2013.01)

(58) Field of Classification Search

CPC ..... A42B 3/085; A42B 3/125; A42B 3/324; A42B 3/12

USPC ..... 2/6.1, 418, 420, 421, 183

See application file for complete search history.

(56) References Cited

U.S. PATENT DOCUMENTS

| | | | | |
|---|---|---|---|---|
| 6,968,575 | B2 * | 11/2005 | Durocher | 2/425 |
| 7,954,178 | B2 * | 6/2011 | Durocher et al. | 2/425 |
| 2007/0199136 | A1 * | 8/2007 | Brine et al. | 2/410 |
| 2012/0054947 | A1 | 3/2012 | Durocher | |
| 2014/0259315 | A1 * | 9/2014 | Durocher | 2/414 |

* cited by examiner

*Primary Examiner* — Anna Kinsaul

(57) ABSTRACT

A sport helmet having an outer shell, an inner padding for covering at least partially the wearer's head, an occipital inner pad for facing the occipital region of the wearer's head, a rear support having an upper part hingedly mounted to the helmet and a lower part mounted to the occipital inner pad, and a biasing member having a portion abutting the rear inner surface of the outer shell such that the rear support and occipital inner pad are movable between a first position wherein the rear support is biased to extend inwardly from the rear inner surface, and a second position when the wearer puts on the sport helmet to cause the rear support and occipital inner pad to be deflected towards the rear inner surface while the rear support and occipital inner pad maintain pressure on the occipital region of the wearer's head.

27 Claims, 17 Drawing Sheets

SPORT HELMET COMPRISING AN OCCIPITAL INNER PAD MOUNTED TO A MOVABLE REAR SUPPORT

FIELD OF THE INVENTION

The present invention relates to a sport helmet comprising an occipital inner pad mounted to a rear support that is movable when the wearer puts on the helmet for improving the fit of the sport helmet on the wearer's head.

BACKGROUND OF THE INVENTION

U.S. Publication 2012/0054947 entitled Helmet comprising an Occipital Adjustment Mechanism and published on Mar. 8, 2012 relates to a hockey or lacrosse helmet comprising a back inner pad for facing the back, left and right side regions of the wearer's head, an occipital inner pad located below the back inner pad for facing the occipital region of the wearer's head, a central member extending along the longitudinal axis of the helmet and comprising an upper part hingedly mounted with respect to the helmet shell and a lower part mounted to the occipital inner pad, a single wedging member located between the helmet shell and the central member an a single actuator connected to the single wedging member. The single actuator and wedging member are movable along the longitudinal axis of the helmet from a first position to a second position wherein, in use, in the first position, the occipital inner pad applies a first pressure upon the occipital region of the wearer's head, and in the second position, the occipital inner pad applies a second pressure upon the occipital region of the wearer's head, the second pressure being greater than the first pressure.

While the use of a single actuator and wedging member eliminates the use of two actuators and/or wedging members and allows the wearer to adjust the fit in the occipital region of the wearer's head in an easy and convenient way, there is still a need in the industry for a sport helmet which further reduces both the manufacturing cost and number of components, simplifies the design of the helmet and provide a proper helmet fit on the wearer's head.

SUMMARY OF THE INVENTION

As embodied and broadly described herein, according to a broad aspect, the invention provides a sport helmet for receiving a head of a wearer, the wearer's head having a crown region, a top region, left and right side regions, a back region and an occipital region, the sport helmet extending along a longitudinal axis residing within an imaginary longitudinal plan that bisects the helmet in two generally identical halves, the sport helmet comprising: (a) an outer shell comprising a front shell portion and a rear shell portion, the rear shell portion comprising an outer surface and an inner surface; (b) an inner padding in the outer shell, the inner padding comprising a front portion for covering at least part of the crown region and top and left and right side regions of the wearer's head and a back portion for covering at least part of the back region and top and left and right side regions of the wearer's head; (c) an occipital inner pad located below the back portion of the inner padding for facing the occipital region of the wearer's head; (e) a rear support comprising an upper part hingedly mounted to the back portion of the inner padding or the rear shell portion and a lower part mounted to the occipital inner pad; and (d) a biasing member between the inner surface of the rear shell portion and the rear support, the biasing member having a portion abutting the inner surface of the rear shell portion such that the rear support and occipital inner pad are movable between a first position wherein the rear support is biased to extend inwardly from the inner surface of the rear shell portion, and a second position when the wearer puts on the sport helmet, wherein the rear support and occipital inner pad are deflected towards the inner surface of the rear shell portion while the rear support and occipital inner pad maintain pressure on the occipital region of the wearer's head.

According to another broad aspect, the invention provides a sport helmet for receiving a head of a wearer, the wearer's head having a crown region, a top region, left and right side regions, a back region and an occipital region, the sport helmet extending along a longitudinal axis residing within an imaginary longitudinal plan that bisects the helmet in two generally identical halves, the sport helmet comprising: (a) an outer shell comprising a front shell portion and a rear shell portion, the rear shell portion comprising an outer surface and an inner surface; (b) an inner padding mounted in the outer shell, the inner padding comprising a front portion for covering at least part of the crown region and top and left and right side regions of the wearer's head and a back portion for covering at least part of the back region and top and left and right side regions of the wearer's head; (c) an occipital inner pad located below the back portion of the inner padding for facing the occipital region of the wearer's head; and (e) a rear support comprising an upper part hingedly mounted to the back portion of the inner padding or the rear shell portion and a lower part mounted to the occipital inner pad, the rear support comprising a biasing member extending towards the inner surface of the rear shell and having a portion abutting the inner surface of the rear shell portion such that the rear support and occipital inner pad are movable between a first position wherein the rear support is biased to extend inwardly from the inner surface of the rear shell portion, and a second position when the wearer puts on the sport helmet, wherein the rear support and occipital inner pad are deflected towards the inner surface of the rear shell portion while the rear support and occipital inner pad maintain pressure on the occipital region of the wearer's head.

According to a further broad aspect, the invention provides a sport helmet for receiving a head of a wearer, the wearer's head having a crown region, a top region, left and right side regions, a back region and an occipital region, the sport helmet extending along a longitudinal axis residing within an imaginary longitudinal plan that bisects the helmet in two generally identical halves, the sport helmet comprising: (a) an outer shell comprising a front shell portion and a rear shell portion, the rear shell portion comprising an outer surface and an inner surface; (b) an inner padding mounted in the outer shell, the inner padding comprising a front portion for covering at least part of the crown region and top and left and right side regions of the wearer's head and a back portion for covering at least part of the back region and top and left and right side regions of the wearer's head; (c) an occipital inner pad located below the back portion of the inner padding for facing the occipital region of the wearer's head; and (e) a rear support comprising an upper part hingedly mounted to the back portion of the inner padding or the rear shell portion and a lower part mounted to the occipital inner pad, the rear support comprising a biasing member made of a resilient material and having a proximal end portion integrally joined with the rear support and a distal end portion, the biasing member extending towards the inner surface of the rear shell such that the distal end portion abuts the inner surface of the rear shell portion, the rear support and occipital inner pad being movable between a first position wherein the rear support is biased to extend inwardly from the inner surface of the rear shell portion, and a second position when the wearer puts on the sport helmet, wherein the rear support and occipital inner pad are deflected towards the inner surface of the rear shell portion while the rear support and occipital inner pad maintain pressure on the occipital region of the wearer's head.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of the embodiments of the present invention is provided herein below, by way of example only, with reference to the accompanying drawings, in which.

Figure 1:
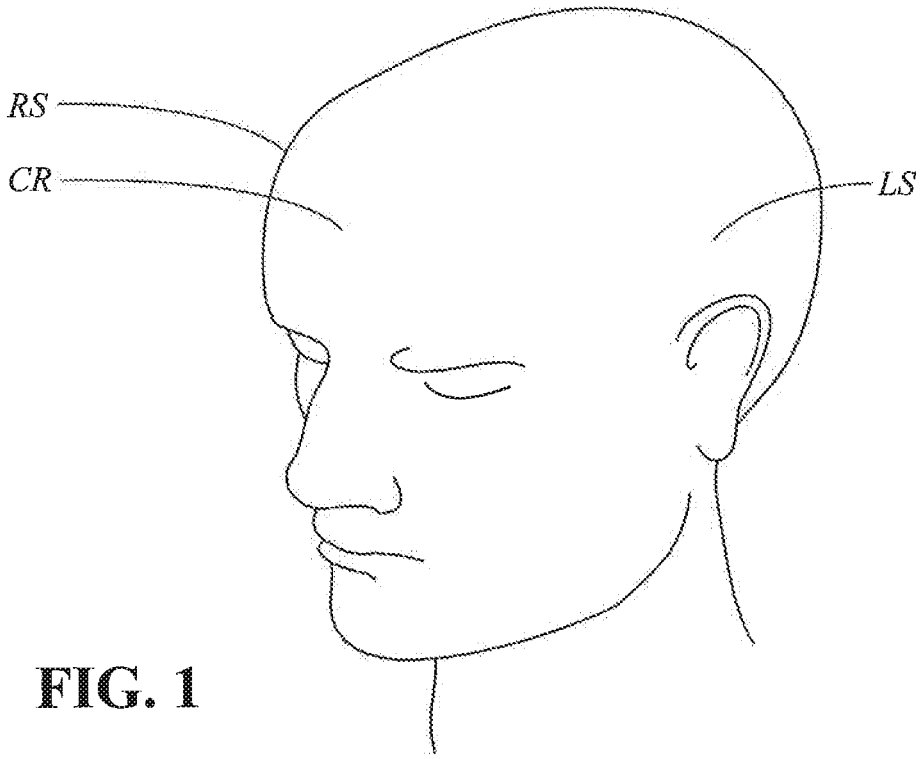
FIG. 1 is a perspective view of a head of a wearer.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
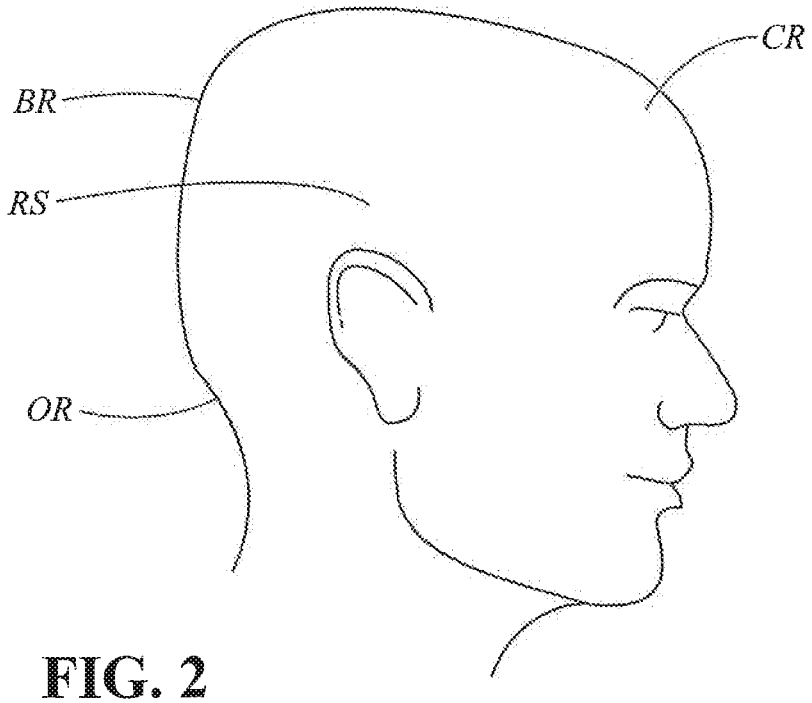
FIG. 2 is a right side elevational view of the head of the wearer of FIG. 1.

FIGS. 1 and 2 illustrate a head of a wearer. The head comprises a crown region CR, left and right side regions LS, RS, a back region BR and an occipital region OR. The crown region CR has a front part that substantially corresponds to the forehead and a top part that substantially corresponds to the front top part of the wearer's head. In fact, the crown region CR generally corresponds to the frontal bone region of the wearer's head. The left and right side regions LS, RS are approximately located above the ears of the player. The occipital region OR substantially corresponds to the region around and under the external occipital protuberance of the wearer's head.

Figure 3:
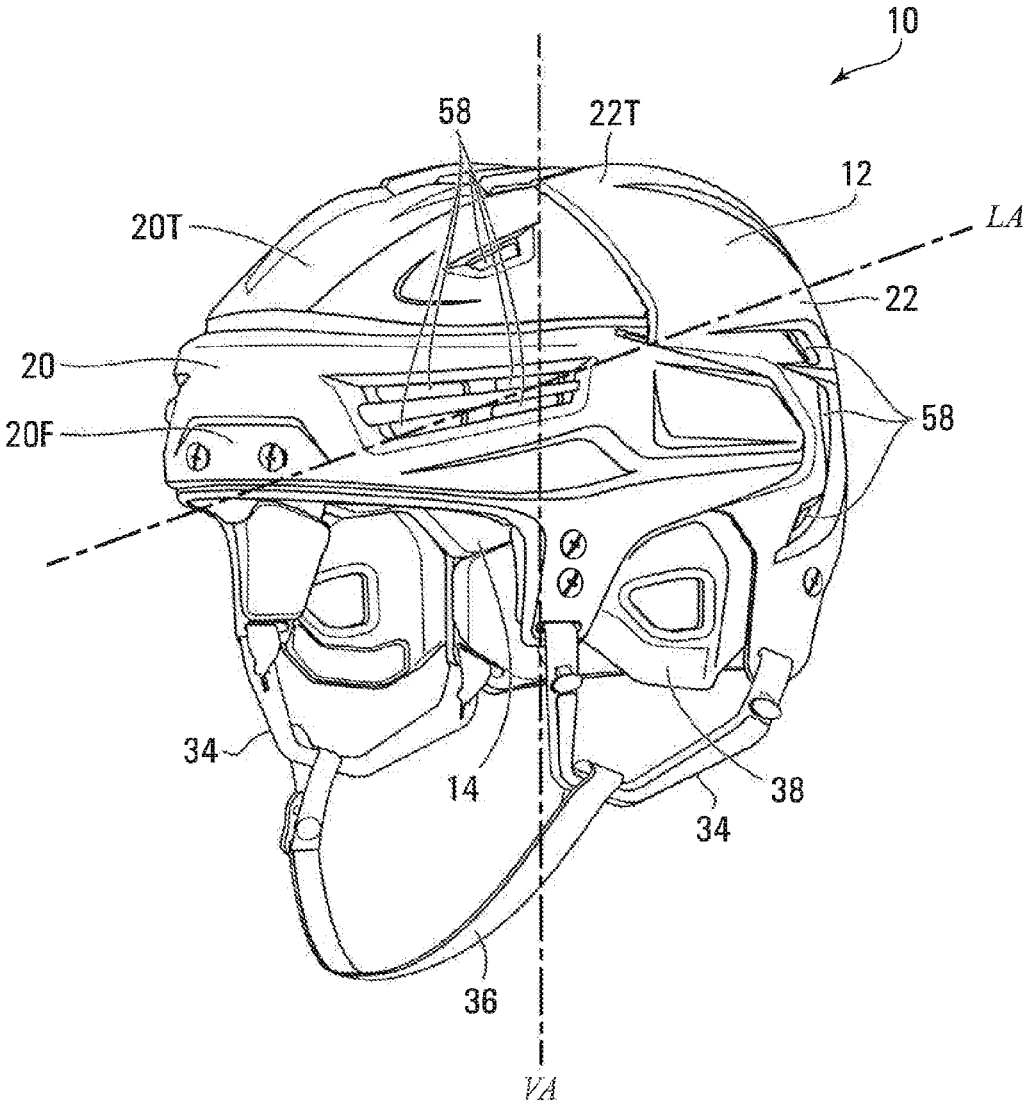
FIG. 3 is a front perspective view of a sport helmet constructed in accordance with an embodiment of the invention.
Figure 4:
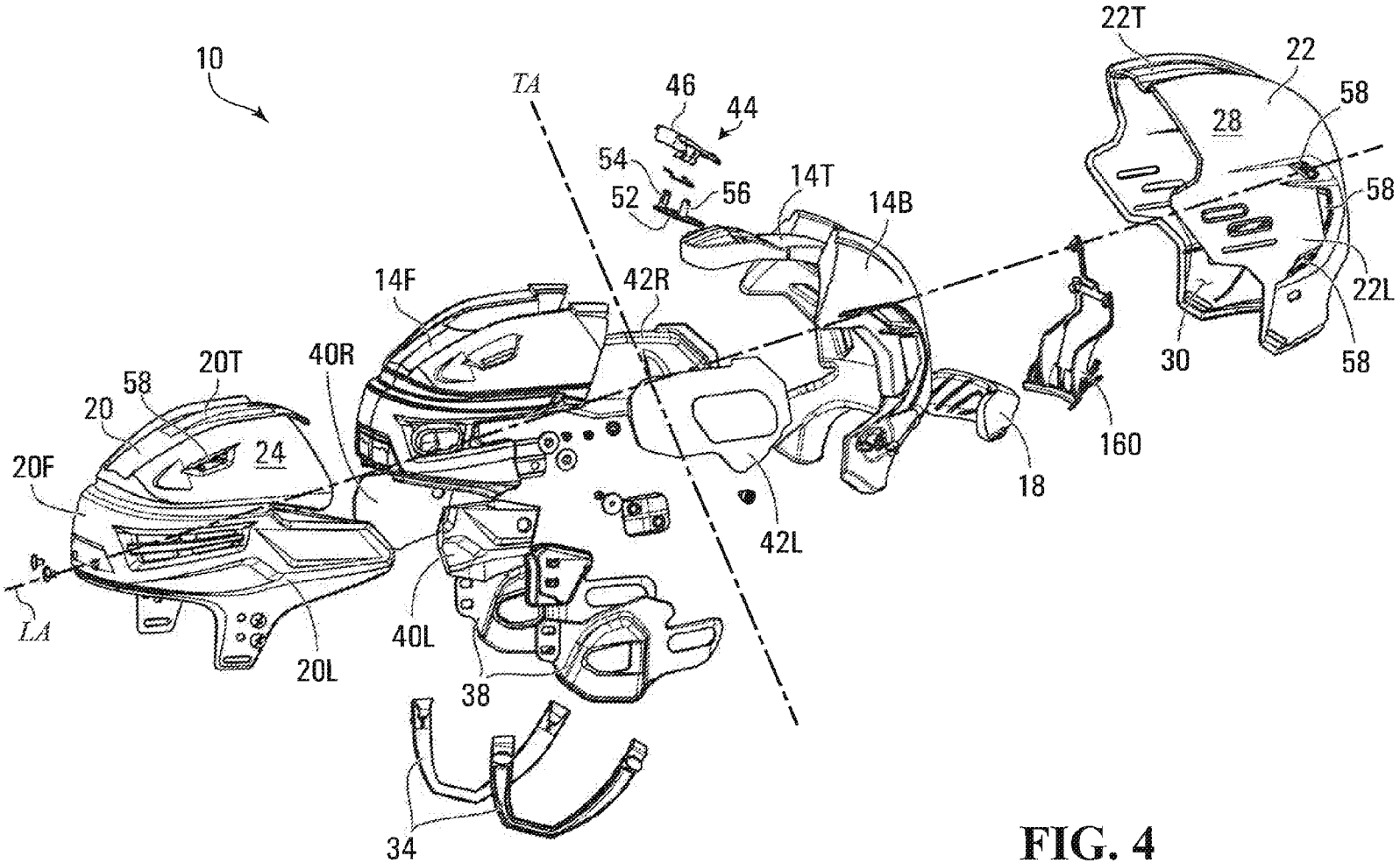
FIG. 4 is a front perspective exploded view of the sport helmet of FIG. 3.
Figure 5:
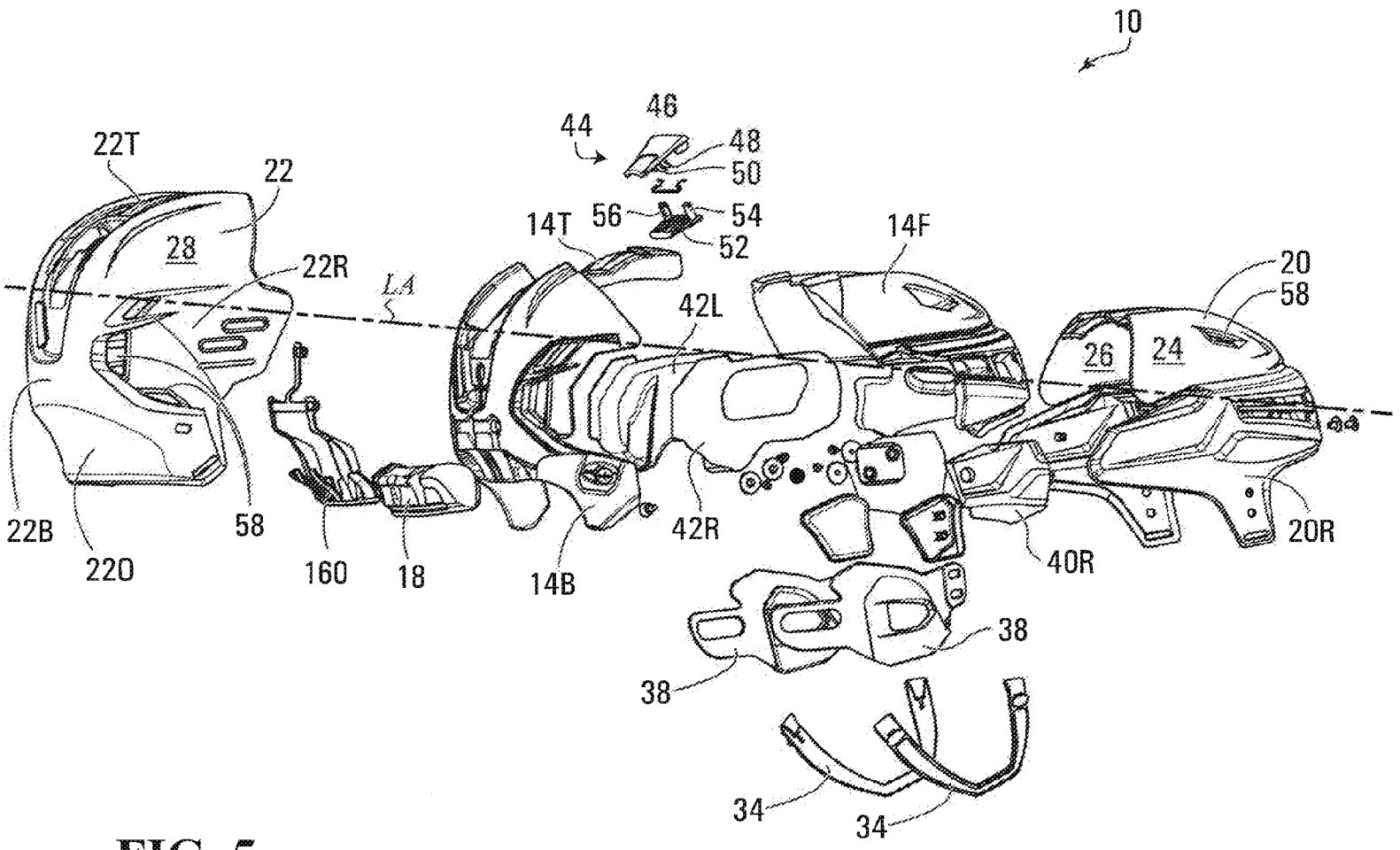
FIG. 5 is a rear perspective exploded view of the sport helmet of FIG. 3.
Figure 6A:
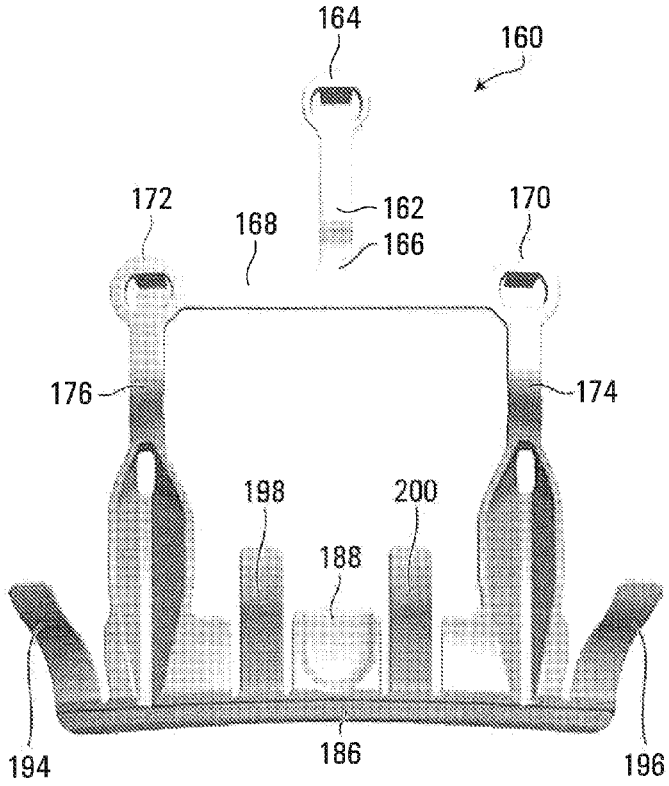
FIG. 6A is a rear perspective view of a rear support according to a first embodiment of the invention.
Figure 6B:
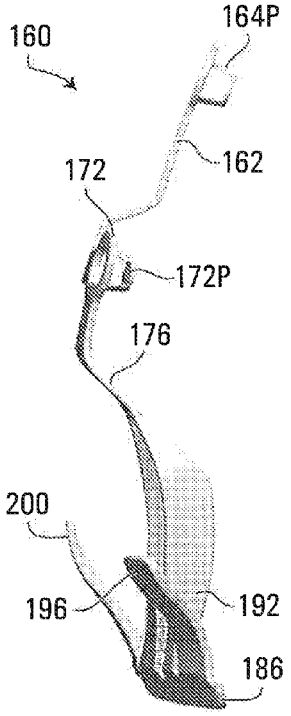
FIG. 6B is a side perspective view of the rear support of FIG. 6A.
Figure 6D:
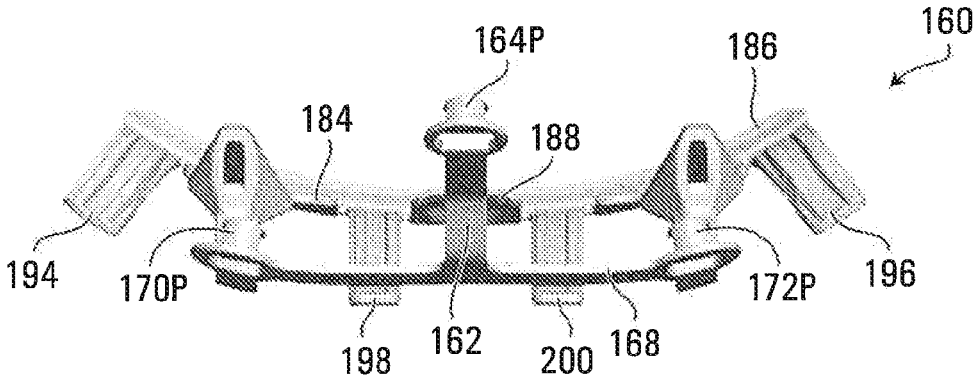
FIG. 6D is a top perspective view of the rear support of FIG. 6A.
Figure 6C:
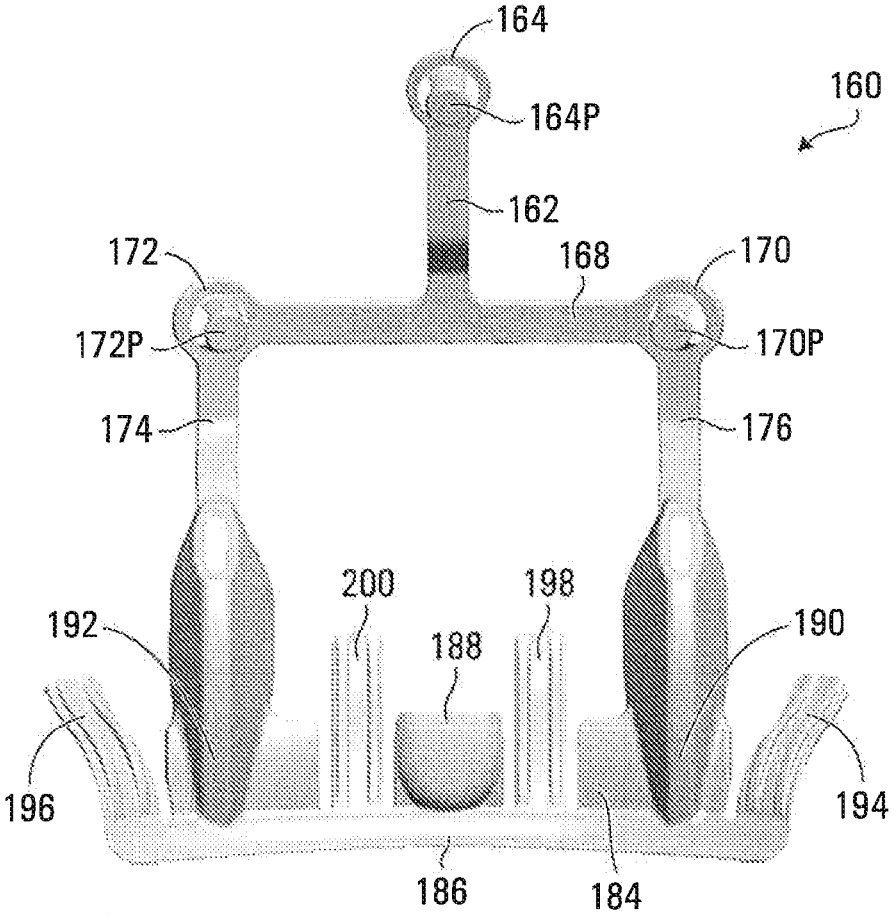
FIG. 6C is a front perspective view of the rear support of FIG. 6A.
Figure 7:
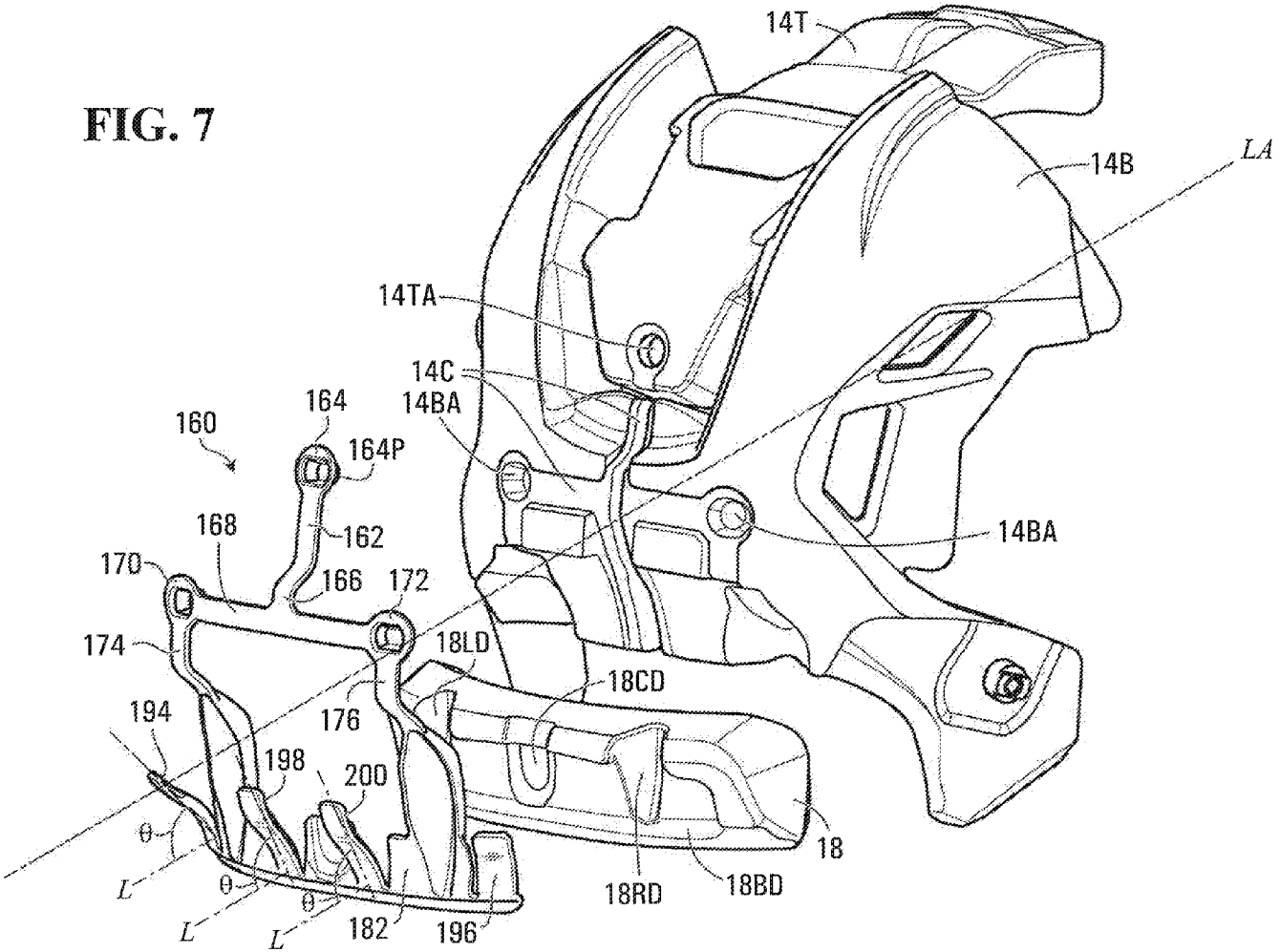
FIG. 7 is a rear perspective exploded view of the top inner pad, back inner pad, occipital inner pad and rear support.
Figure 8:
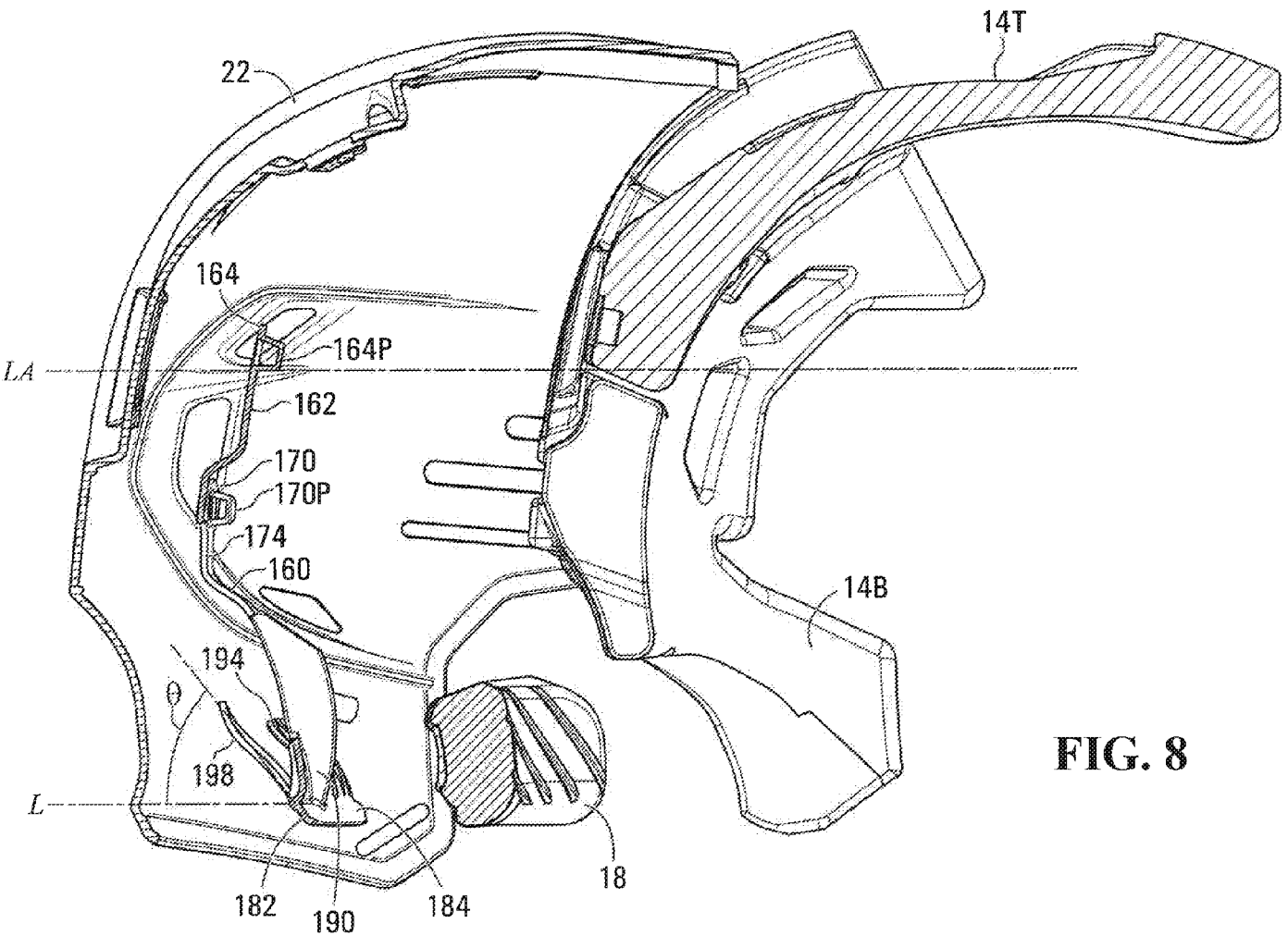
FIG. 8 is a cross-sectional exploded view of the rear shell portion, rear support, occipital inner pad, back inner pad, and top inner pad of the sport helmet of FIG. 3.
Figure 9:
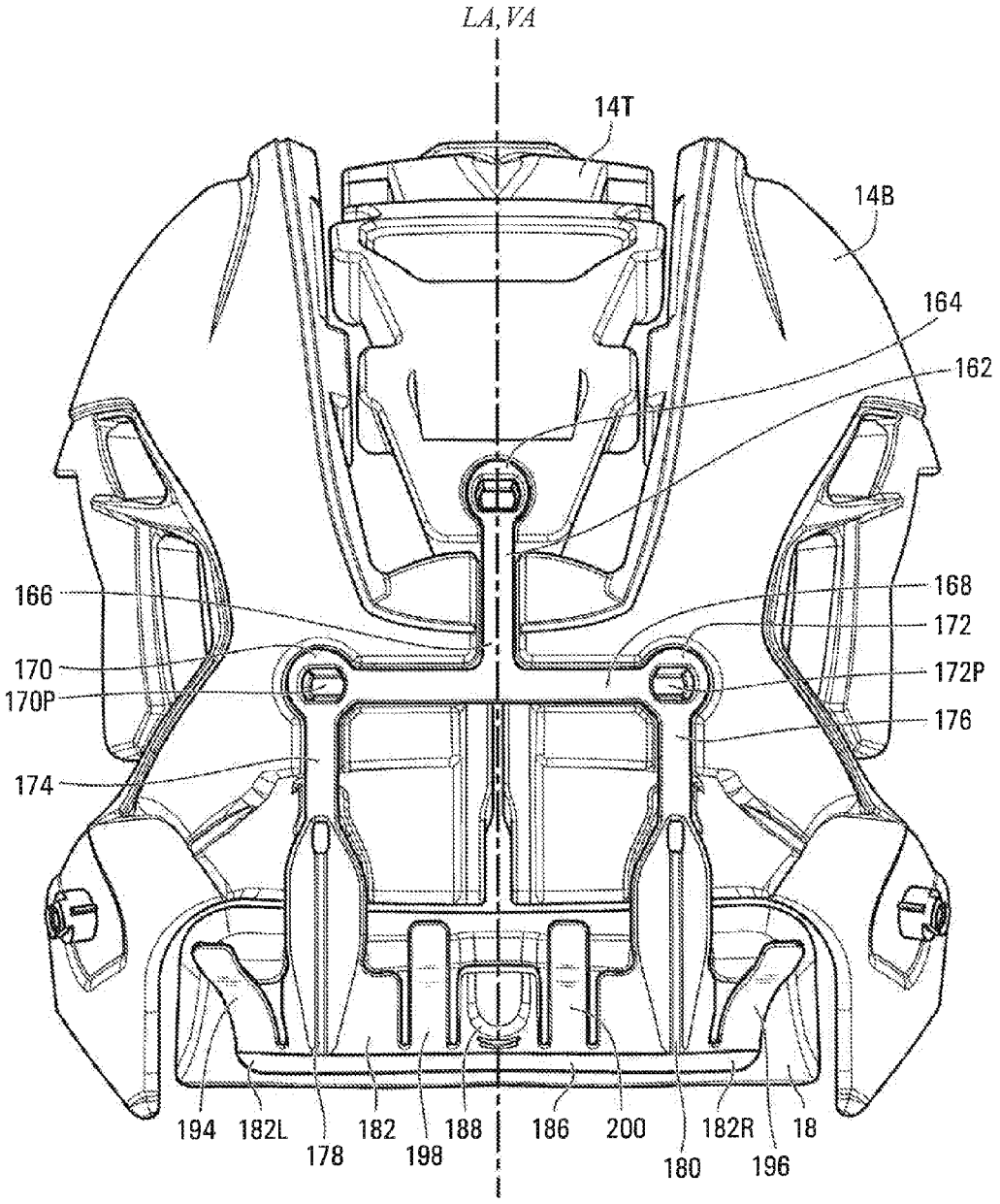
FIG. 9 is a rear view of the top inner pad, back inner pad, occipital inner pad and rear support according to the first embodiment of the invention.

FIGS. 3 to 5 show an example of a helmet 10 for protecting the head of a wearer in accordance with an embodiment of the invention. In this embodiment, the helmet 10 is a sport helmet for protecting the head of the wearer who is a sport player. More particularly, in this embodiment, the sport helmet 10 is a hockey or lacrosse helmet for protecting the head of the wearer who is a hockey or lacrosse player. It is noted, however, that the invention is not limited to any particular type of sport helmet. For instance, a sport helmet constructed using principles described herein in respect of the sport helmet 10 may be used for protecting the head of a player of another type of contact sport (sometimes referred to as "full-contact sport" or "collision sport") in which there are significant impact forces on the player due to player-to-player and/or player-to-object contact. For example, in one embodiment, a sport helmet constructed using principles described herein in respect of the sport helmet 10 may be a football helmet for protecting the head of a football player. Furthermore, a sport helmet constructed using principles described herein in respect of the sport helmet 10 may be for protecting the head of a wearer involved in a sport other than a contact sport (e.g., bicycling, motorcycle, skiing, snowboarding, horseback riding or another equestrian activity, etc.).

The sport helmet 10 defines a cavity for receiving the wearer's head to protect the head when the sport helmet 10 is impacted (e.g., when the sport helmet 10 hits a board, ice or other playing surface or is struck by a puck, ball, a lacrosse or hockey stick, or when the player is receiving a hit (e.g., body check) by another player and the head of the player is hit directly or indirectly).

The sport helmet 10 has a front-back axis, a left-right axis, and a vertical axis VA which are respectively generally parallel to a dorsoventral axis, a dextrosinistral axis, and a cephalocaudal axis of the wearer when the sport helmet 10 is worn and which respectively define a front-back direction, a left-right direction, and a vertical direction of the sport helmet 10. Since they are generally oriented longitudinally and transversally of the sport helmet 10, the front-back axis and the left-right axis can also be referred to as a longitudinal axis LA and a transversal axis TA, respectively, while the front-back direction and the left-right direction can also be referred to a longitudinal direction and a transversal direction. The longitudinal axis LA may be seen as an axis that resides within an imaginary longitudinal plan that bisects the sport helmet in two generally identical halves.

The helmet 10 has an outer shell 12, inner padding 14, a rear support 160 and an occipital inner pad 18 mounted to the rear support 160. The outer shell 12 may comprises a front shell portion 20 and a rear shell portion 22, the front shell portion 20 comprising outer and inner surfaces 24, 26 and the rear shell portion 22 comprising outer and inner surfaces 28, 30.

The front and rear shell portions 20, 22 may be made of a relatively rigid material, such as polyethylene, NYLON, polycarbonate materials, thermoplastics, or thermosetting resins or any other suitable material.

The sport helmet 10 also comprises ear loops 34 and a chinstrap 36 for securing the sport helmet 10 to the wearer's head. The sport helmet 10 may further comprise ear protectors 38 for protecting the left and right ears of the wearer.

The front outer shell portion 20 comprises a top portion 20T for facing at least part of the top region TR of the wearer's head, a front portion 20F for facing at least part of the front region FR of the wearer's head, and left and right side portions 20L, 20R extending rearwardly from the front portion 20F for facing at least part of the left and right side regions LS, RS of the wearer's head.

The rear outer shell portion 22 comprises a top portion 22T for facing at least part of the crown region CR and top region TR of the wearer's head, a back portion 22B for facing at least part of the back region BR and top region TR of the wearer's head, an occipital portion 22O for facing at least part of the occipital region OR of the wearer's head, and left and right side portions 22L, 22R extending forwardly from the back portion 22B for facing at least part of the left and right side regions (LS, RS respectively) of the wearer's head.

The front and rear shell portions 20, 22 overlay the inner padding 14, which may have a front inner pad 14F for covering at least part of the crown region CR and top region TR of the wearer's head, a top inner pad 14T for covering at least part of the top region TR of the wearer's head and a back inner pad 14B for covering at least part of the back region BR and top region TR of the wearer's head. Each of the inner pads 14F, 14T, 14B comprises shock-absorbing material to absorb impact energy when the sports helmet 10 is impacted. For example, in this embodiment, each of the inner pads 14F, 14T, 14B comprises polymeric cellular material. For instance, the polymeric cellular material may comprise polymeric foam such as expanded polypropylene (EPP) foam, expanded polyethylene (EPE) foam, or any other suitable polymeric foam material and/or may comprise expanded polymeric microspheres (e.g., Expancel™ microspheres commercialized by Akzo Nobel). Any other material with suitable impact energy absorption may be used for the inner padding 14 in other embodiments.

The front inner pad 14F has a three-dimensional external configuration that matches the three-dimensional internal configuration of the front shell portion 20 and is mounted to the front shell portion 20 by any suitable affixing means, such as glue, stitches, tacks, staples or rivets. Similarly, the back inner pad 14B has a three-dimensional external configuration that matches the three-dimensional internal configuration of the rear shell portion 22 and is mounted to the rear shell portion 22 by any suitable means, such as glue, stitches, tacks, staples or rivets.

The helmet 10 may also comprise left and right side comfort pads 40L, 42L, 40R, 42R affixed on the inner surface of the front inner pad 14F. The comfort pads 40L, 40R, 42L, 42R comprise any suitable soft material providing comfort to the wearer. For example, in some embodiments, the comfort pad members 40L, 40R, 42L, 42R may comprise polymeric foam such as polyvinyl chloride (PVC) foam or polyurethane foam (e.g., PORON XRD foam commercialized by Rogers Corporation).

The inner padding 14 may be implemented in various other ways in other embodiments. For example, in other embodiments, the inner padding 14 may comprise any number of pads (e.g.: two pads such as a first pad that faces at least part of the front region FR, top region TR, and left and right side regions LS, RS of the wearer's head and another second pad that faces at least part of the back region BR, top region TR, and left and right side regions LS, RS of the wearer's head; a single pad that faces at least part of the front region FR, top region TR, left and right side regions LS, RS, and back region BR of the wearer's head; etc.).

The occipital inner pad 18 is located below the back inner pad 14B for facing the occipital region OR of the wearer head. The occipital inner pad 18 may be made of expanded polypropylene (EPP) or expanded polyethylene (EPE) or polypropylene foam or polyethylene foam having two different densities. Other materials can also be used for the occipital inner pad 18 without departing from the spirit of the invention.

The sport helmet 10 may be adjustable to adjust and improve its fit on the wearer's head. To this end, the sport helmet 10 comprises an adjustment mechanism 44 for adjusting a fit of the sport helmet 10 on the wearer's head 11. The adjustment mechanism 44 allows the fit of the sport helmet 10 to be adjusted by being operable by the wearer to vary the internal volume of the cavity of the sport helmet 10. This can be done by adjusting one or more of the internal dimensions of the cavity of the sport helmet 10, such as the longitudinal dimension of the cavity in the front-back direction of the sport helmet 10 and/or the transversal dimension of the cavity in the left-right direction of the sport helmet 10.

More particularly, in this embodiment, the outer shell 12 and the inner padding 14 are adjustable to adjust the fit of the sport helmet 10 on the wearer's head. To that end, in this case, the front shell portion 20 is a separate front shell member and the rear shell portion 22 is a rear shell member, these front and rear shell members being movable relative to one another to adjust the fit of the sport helmet 10 on the wearer's head. The adjustment mechanism 44 is connected between the front shell member and the rear shell member to enable adjustment of the fit of the sport helmet 10 by moving the shell members relative to one another. In this example, relative movement of the outer shell members for adjustment purposes is in the front-back direction of the sport helmet 10 such that the front-back internal dimension of the cavity of the sport helmet 10 is adjusted.

As is best shown in FIGS. 4 and 5, the adjustment mechanism 44 may comprise an actuator 46 mounted to the rear shell member and that can be moved (in this case pivoted) by the wearer between a locked position, in which the actuator 46 engages a part of the front shell member and thereby locks the shell members relative to one another, and a released position, in which the actuator 46 is disengaged from the part of the front shell member and thereby permits the shell members to move relative to one another so as to adjust the size of the helmet 10.

In use, a wearer who puts on the helmet 10 and realizes that it is too large or too small does not need to remove the helmet 10 to adjust it. Instead, the wearer just simply pivots outwardly (opens) the actuator 46, expands or contracts the size of the helmet 10 by displacing the front and rear shell members in relation to each other in the appropriate direction, and then pivots inwardly (closes) the actuator 46 when the internal size of the helmet is adequate.

The actuator 46 may comprise first and second pairs of teeth 48, 50 extending generally transversely relative to the longitudinal axis LA in the locked position. The actuator 46 can be moved (in this case pivoted) by the wearer between a locked position, in which the first and second pairs of teeth 48, 50 engage in first and second plurality of pairs of apertures provided on the front shell member and thereby locks the shell members relative to one another, and a released position, in which the first and second pairs of teeth 48, 50 are disengaged from the first and second pairs of apertures of the front shell member and thereby permits the shell members to move relative to one another so as to adjust the size of the sport helmet 10. It is understood that the actuator may comprise only one tooth, or only one pair of teeth instead of the first and second pairs of teeth 48, 50. The adjustment mechanism 44 may also comprise a base member 52 having first and second posts 54, 56 to which the actuator 46 is pivotably mounted and the base member 52 may comprise first and second apertures for receiving the pair of first and second teeth 48, 50. Again, it is understood that the base member 52 may comprise only one aperture if the actuator 46 has only one tooth or only one pair of teeth. The base member 52 may be mounted between the top pad 14T and the front shell member and the first and second posts 54, 56 may extend in left and right apertures provided on the rear shell member. The adjustment mechanism 44 may be implemented in various other ways in other embodiments.

The outer shell 12 may comprise a plurality of ventilation holes 58 for allowing air to circulate around the wearer's head. In this case, each of the front and rear shell portions 20, 22 includes a plurality of ventilation apertures 58 that allow air to circulate around the head of the player to improve the player's comfort level The outer shell 12 may be implemented in various other ways in other embodiments. For example, the outer shell may comprise separate front and rear shell members that are connected to one another in any suitable way, but are not adjustable relative to the other.

In another possible variant, the front and rear shell portions may be integrally formed together such that the outer shell 12 is a single one-piece shell. In such embodiments, the adjustment mechanism may comprise an internal adjustment device located within the sport helmet 10 and having a head-facing surface movable relative to the wearer's head in order to adjust the fit of the sport helmet 10. For instance, in some cases the internal adjustment device may comprise an internal pad member movable relative to the wearer's head or an inflatable member which can be inflated so that its surface can be moved closer to or further from the wearer's head to adjust the fit.

As is best shown in FIGS. 6A to 6D, 7 to 9, 10A and 10B, the rear support 160 has an upper part or member 162 hingedly mounted to the back inner pad 14B, the top inner pad 14T or the rear shell portion 22. The upper member 162 extends along the longitudinal axis LA and has a top end portion 164 hingedly mounted with respect to the back and top inner pads 14B, 14T and a bottom end portion 166. The top end portion 164 has an inner projection or peg 164P and the top inner pad 14T has a hole or aperture 14TA for receiving the peg 164P such that the upper member 162 is hingedly mounted to the top inner pad 14T. It is understood that the top end portion 164 can rather be hingedly mounted with respect to the rear shell portion 22.

The rear support 160 also comprises a transversal member 168 extending transversally on each side from the bottom end portion 166 up to left and right end portions 170, 172 and left and right members 174, 176 extending downwardly from the left and right end portions 170, 172 up to left and right bottom end portions 178, 180 that are joined with a lower part or lower member 182 that extends transversally with respect to the longitudinal axis LA front a left end portion 182L to a right end portion 182R.

The left and right end portions 170, 172 has left and right inner projections or pegs 170P, 172P and the back inner pad 14B has left and right holes or apertures 14BA for receiving the left and right pegs 170P, 172P.

The back and top inner pads 14B, 14T may each comprise channeled portions 14C for at least partially receiving the upper, transversal, left and right members 162, 168, 174, 176.

The lower member 182 defines an inner portion 184 to which the occipital inner pad 18 is mounted. For example, the inner portion 184 may comprise a transversal base wall 186 provided on the lower member 182, a central wall 188 projecting upwardly from the base wall 186 and left and right walls 190, 192 extending inwardly from the left and right members 174, 176 and the occipital inner pad 18 may comprise a transversal base channel or depression 18BD for receiving the base wall 186, a central depression 18CD for receiving the central wall 188 and left and right depressions 18LD, 18RD for receiving the left and right walls 190, 192. The occipital inner pad 18 can thus be snugly mounted to the inner portion 184 of the lower member 182 through the engaging connections of the base, central, left and right walls 186, 188, 190, 192 in the base, central, left and right depressions 18BD, 18CD, 18LD, 18RD. Glue or other affixing means can also be used in order to further secure such engaging connections. Alternatively, the inner portion of the lower member may simply define a single wall for receiving the occipital inner pad that can be affixed to the lower member via affixing means such as glue, stitches, rivets, tacks, staples, etc. In another example, the lower member may be attached to the occipital inner pad by virtue of being integral, and therefore continuous, with the occipital inner pad.

The sport helmet also comprises a biasing member between the rear shell portion 22 and the rear support, the biasing member having a portion that abuts the inner surface 30 of the real shell portion 22 such that the rear support and occipital inner pad 18 are movable between a first position wherein the rear support is biased to extend inwardly from the inner surface 30 of the rear shell portion 22, and a second position when the wearer puts on the sport helmet wherein the rear support and occipital inner pad 18 are deflected towards the inner surface 30 of the rear shell portion 22 while the rear support and occipital inner pad 18 maintain pressure on the occipital region OR of the wearer's head.

Figure 10A:
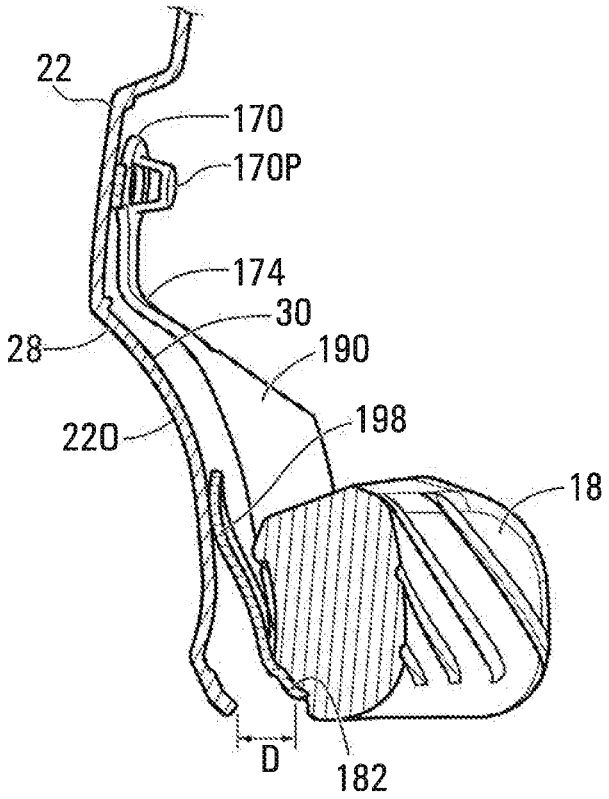
FIG. 10A is a partial enlarged cross-sectional view of the rear shell portion, rear support, and occipital inner pad with the rear support and occipital inner pad shown in a first position.
Figure 10B:
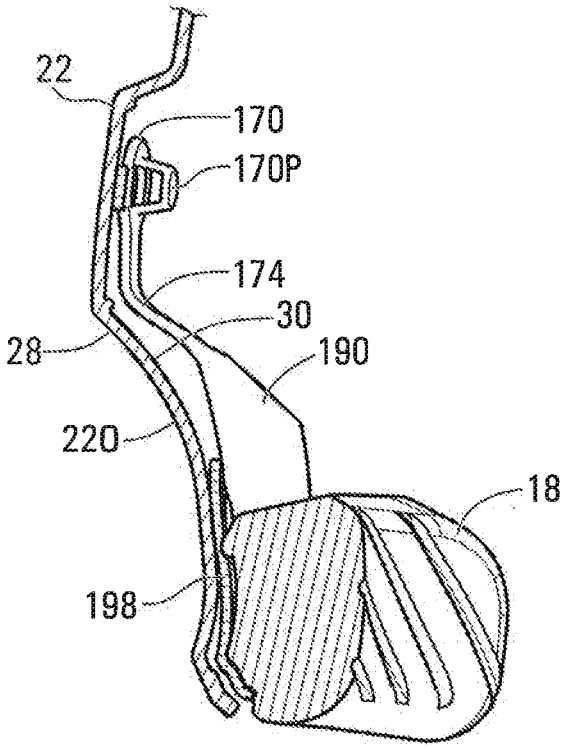
FIG. 10B is a partial enlarged cross-sectional view of the rear shell portion, rear support, and occipital inner pad with the rear support and occipital inner pad shown in a second position.
Figure 11A:
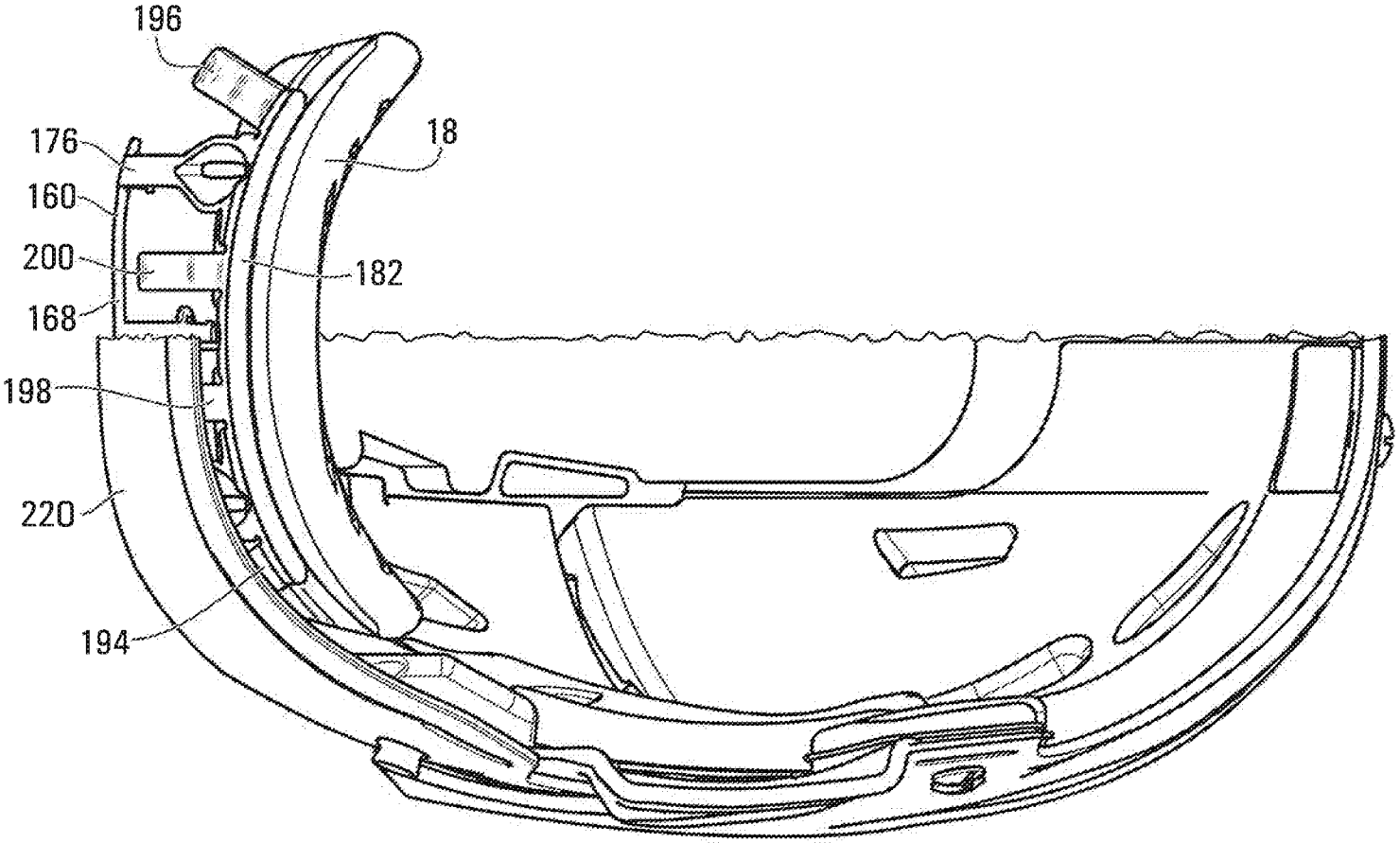
FIG. 11A is a partial bottom view of the sport helmet of FIG. 3 with the rear support and occipital inner pad shown in the first position.
Figure 11B:
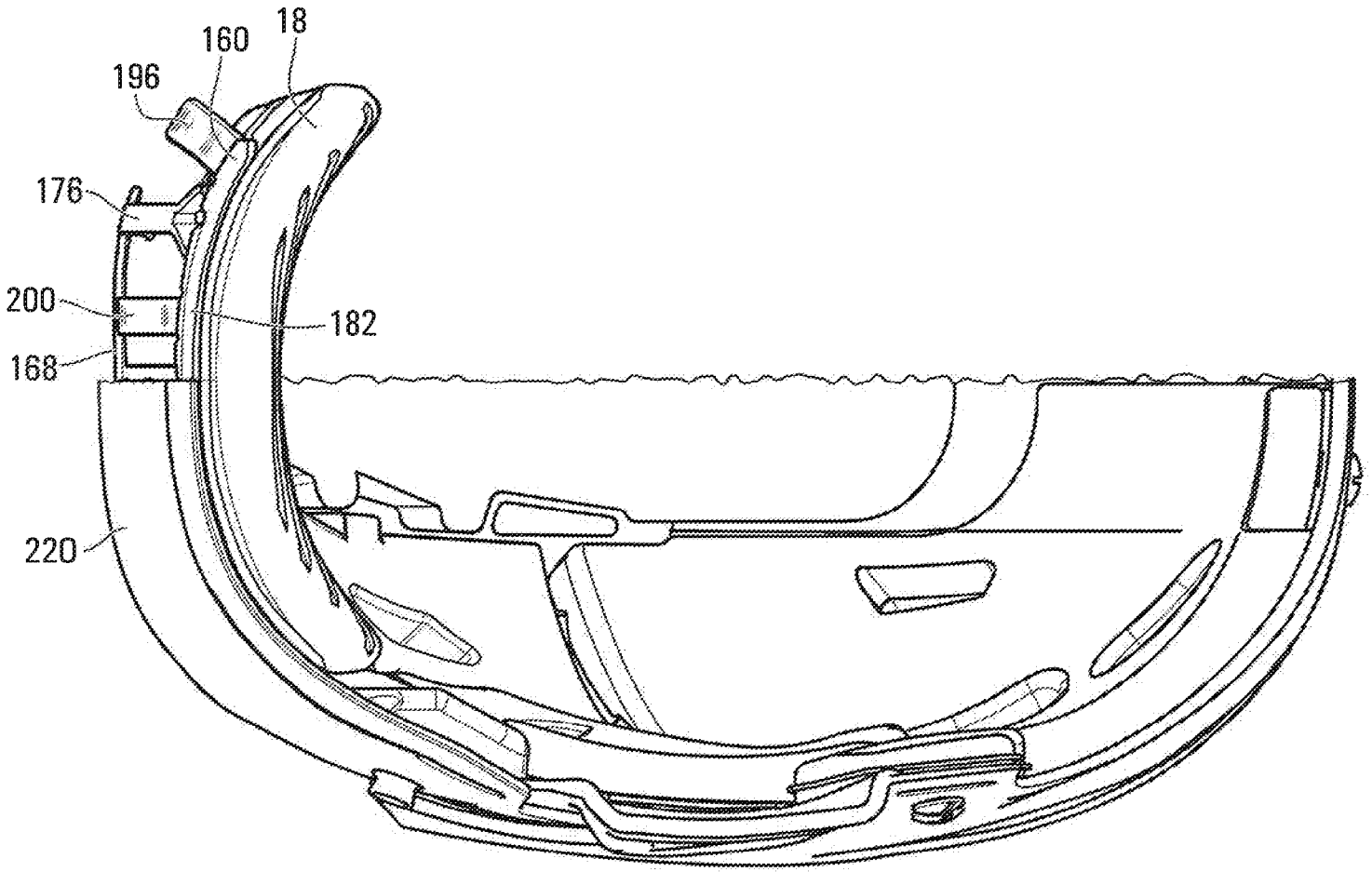
FIG. 11B is a partial bottom view of the sport helmet of FIG. 3 with the rear support and occipital inner pad shown in the second position.

For instance, the biasing member may be provided on the rear support 160 that may comprise left and right end biasing members 194, 196 and left and right middle biasing members 198, 200, each of the biasing members 194, 196, 198, 200 extending rearwardly towards the inner surface 30 of the real shell portion 22, along an acute angle 0 with respect to a longitudinal axis L parallel to the longitudinal axis LA, and having a distal end portion abutting the inner surface 30 of the real shell portion 22 such that the rear support 160 and occipital inner pad 18 are movable between a first position wherein the rear support 160 is biased to extend inwardly from the inner surface 30 of the rear shell portion 22 forming a gap (see FIGS. 10A, 11A), and a second position when the wearer puts on the sport helmet, wherein the rear support 160 and occipital inner pad 18 are deflected towards the inner surface 30 of the rear shell portion 22, reducing the gap, while the rear support 160 and occipital inner pad 18 maintain pressure on the occipital region OR of the wearer's head (see FIGS. 10B, 11B). As best shown in FIG. 10A, in the first position, the lower member 182 of the rear support 160 may extend inwardly from the inner surface 30 of the rear shell portion 22 between a distance D measured along the longitudinal axis LA of about 5 mm to about 20 mm.

In one example, the biasing members 194, 196, 198, 200 may extend along an acute angle Θ that is between 60° and 80°. It is understood that the left and right end biasing members 194, 196 may extend along an acute angle Θ that is different from the acute angle Θ of the left and right middle biasing members 198, 200. For example, in the first position, the left and right end biasing members 194, 196 may extend along an acute angle Θ that is between 65° and 75° and the left and right middle biasing members 198, 200 may extend along an acute angle Θ that is between 60° and 70°.

It is understood that the left and right end biasing members 194, 196 may each have a length that is different from the length of the left and right middle biasing members 198, 200. For example, the left and right end biasing members 194, 196 may have a length that is between 25 mm and 35 mm and the left and right middle biasing members 198, 200 may have a length that is between 20 mm and 30 mm.

The biasing members 194, 196, 198, 200 are made of a resilient material, such as nylon, polyacetal (DELRIN™), polycarbonate or spring steel, any combination of these materials, or any other suitable material that has the ability to return to its original shape when pressure is no longer applied to it, such that the rear support 160 is biased to extend inwardly from the inner surface 30 of the rear shell portion 22 when the sport helmet is not worn by the wearer (first position shown in FIGS. 10A, 11A). It is understood that the rear support 160, including the biasing members 194, 196, 198, 200 may be entirely made of the same resilient material or the biasing members 194, 196, 198, 200 may be made of a resilient material while the remainder of the rear support may be made of a material having a different resiliency.

Figure 12:
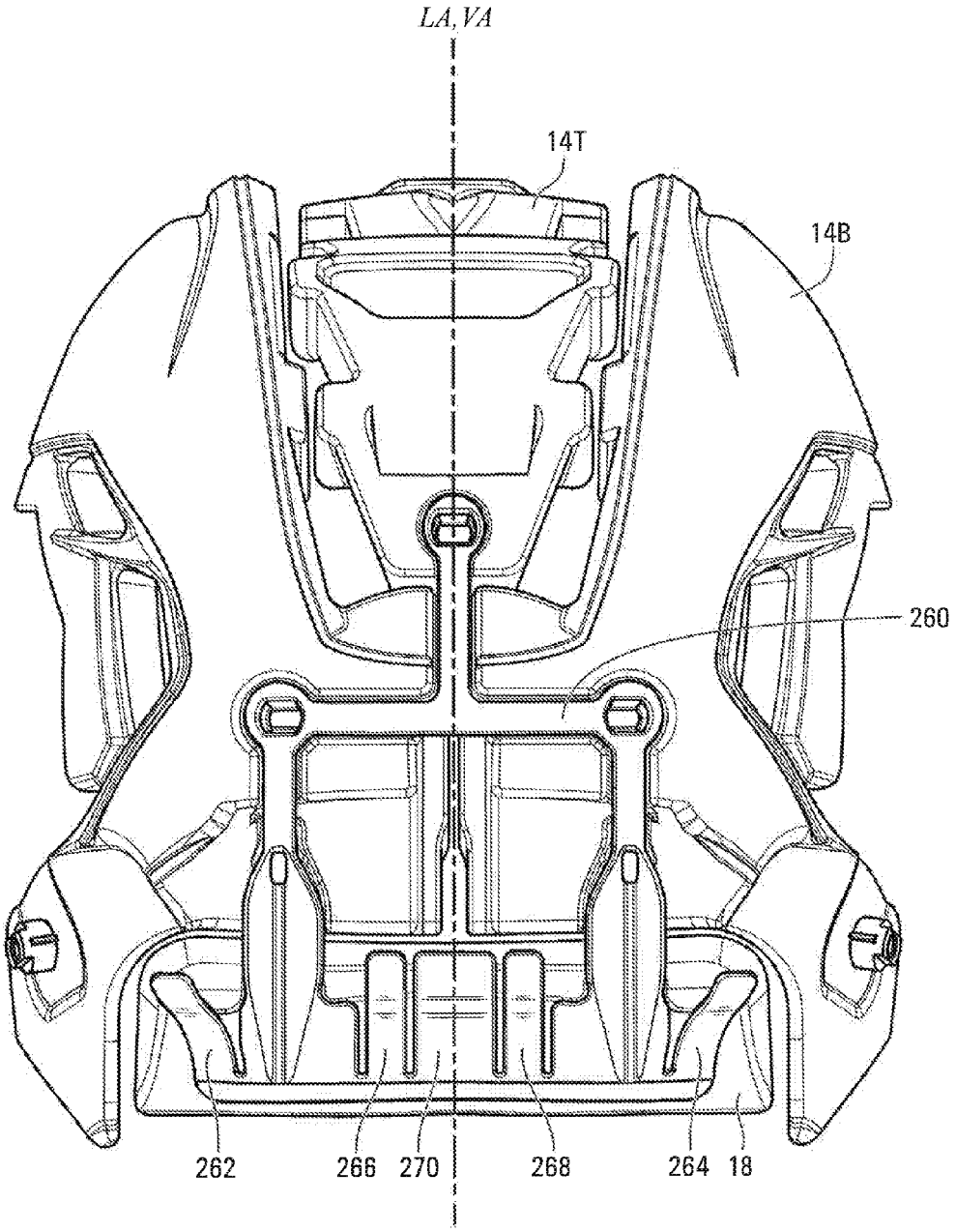
FIG. 12 is a rear view of the top inner pad, back inner pad, occipital inner pad and rear support according to a second embodiment of the invention.

FIG. 12 shows a rear support 260 according to a second embodiment. While the rear support 260 has left and right end biasing members 262, 264 and left and right middle biasing members 266, 268, the rear support 260 also comprises a central biasing member 270, each of the biasing members 262, 264, 266, 268, 270 extending rearwardly towards the inner surface 30 of the real shell portion 22, along an acute angle with respect to a longitudinal axis parallel to the longitudinal axis LA and having a distal end portion abutting the inner surface 30 of the real shell portion 22, such that the rear support 260 and occipital inner pad 18 are movable between a first position wherein the rear support 260 is biased to extend inwardly from the inner surface 30 of the rear shell portion 22, and a second position when the wearer puts on the sport helmet, wherein the rear support 260 and occipital inner pad 18 are deflected towards the inner surface 30 of the rear shell portion 22 while the rear support 260 and occipital inner pad 18 maintain pressure on the occipital region OR of the wearer's head. In this embodiment, the rear support 260 thus comprises five biasing members 262, 264, 266, 268, 270.

Figure 13:
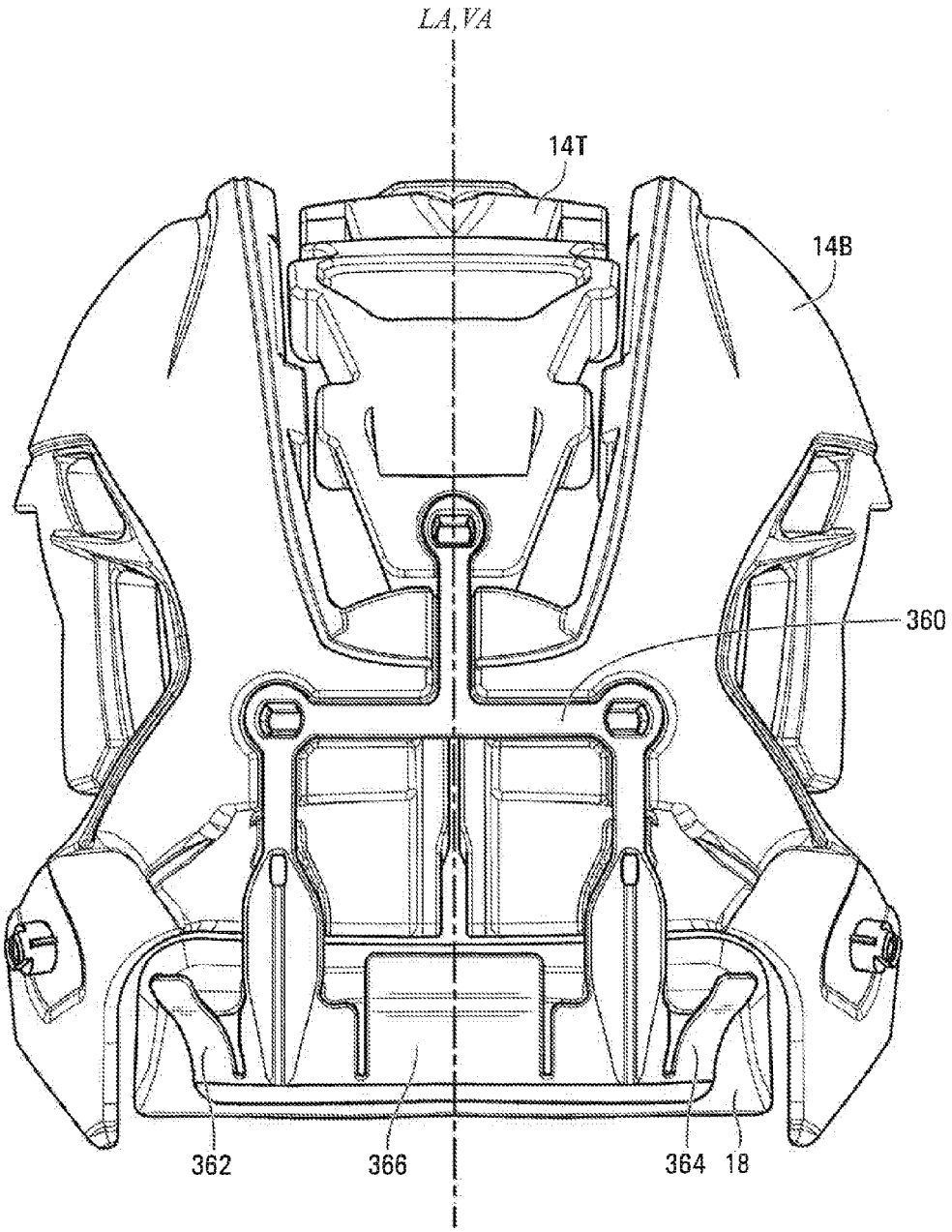
FIG. 13 is a rear view of the top inner pad, back inner pad, occipital inner pad and rear support according to a third embodiment of the invention.

FIG. 13 shows a rear support 360 according to a third embodiment. The rear support 360 has left and right end biasing members 362, 364 and a central biasing member 366, each of the biasing members 362, 364, 366 extending rearwardly towards the inner surface 30 of the rear shell portion 22, along an acute angle with respect to a longitudinal axis parallel to the longitudinal axis LA and having a distal end portion abutting the inner surface 30 of the real shell portion 22 such that the rear support 360 and occipital inner pad 18 are movable between a first position wherein the rear support 360 is biased to extend inwardly from the inner surface 30 of the rear shell portion 22, and a second position when the wearer puts on the sport helmet, wherein the rear support 360 and occipital inner pad 18 are deflected towards the inner surface 30 of the rear shell portion 22 while the rear support 360 and occipital inner pad 18 maintain pressure on the occipital region OR of the wearer's head. In this embodiment, rear support 360 thus comprises three biasing members 362, 364, 366.

Figure 14:
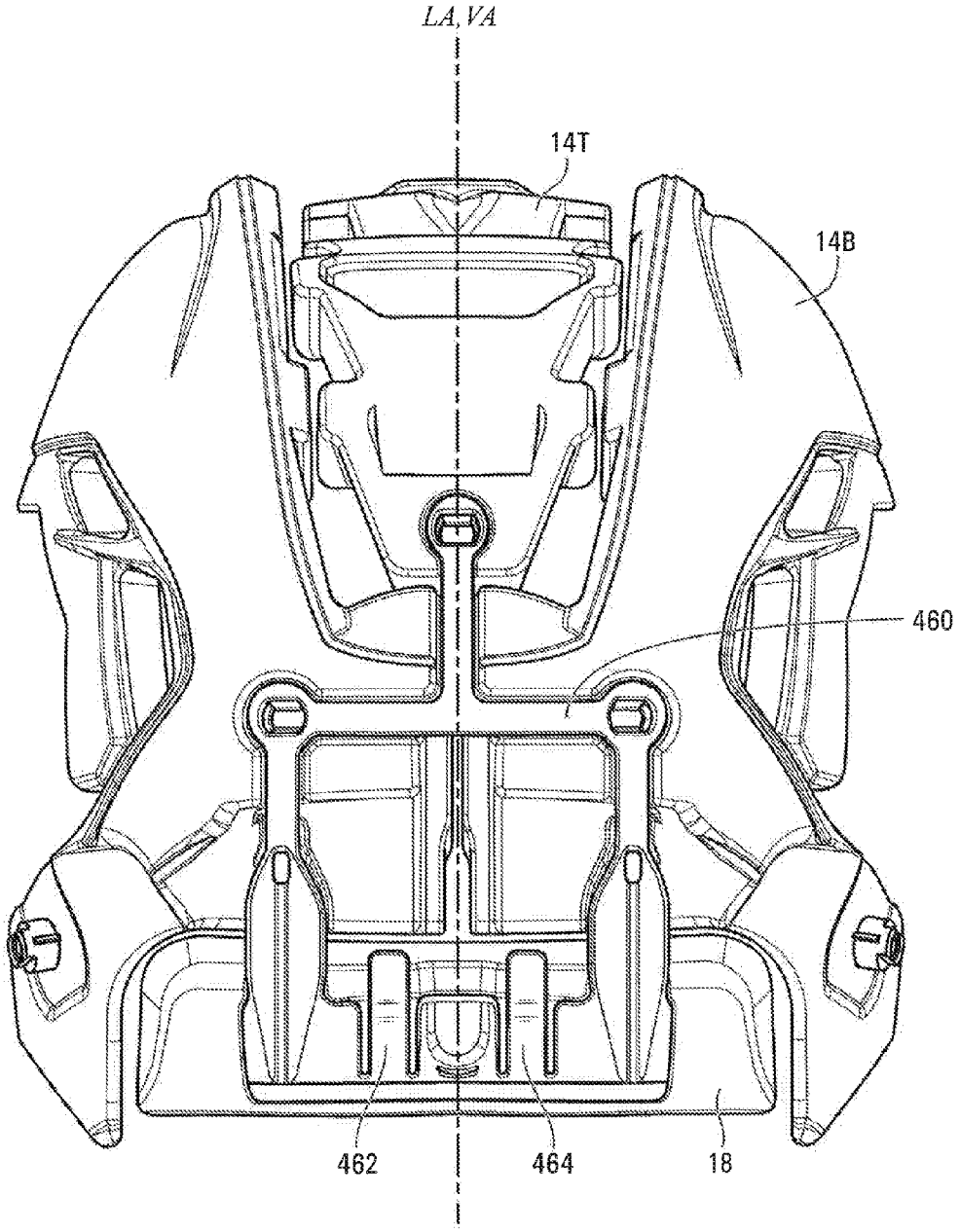
FIG. 14 is a rear view of the top inner pad, back inner pad, occipital inner pad and rear support according to a fourth embodiment of the invention.

FIG. 14 shows a rear support 460 according to a third embodiment. The rear support 460 has left and right middle biasing members 462, 464, each of the biasing members 462, 464 extending rearwardly towards the inner surface 30 of the real shell portion 22, along an acute angle with respect to a longitudinal axis parallel to the longitudinal axis LA, and having a distal end portion abutting the inner surface 30 of the real shell portion 22 such that the rear support 460 and occipital inner pad 18 are movable between a first position, wherein the rear support 460 is biased to extend inwardly from the inner surface 30 of the rear shell portion 22, and a second position when the wearer puts on the sport helmet, wherein the rear support 460 and occipital inner pad 18 are deflected towards the inner surface 30 of the rear shell portion 22 while the rear support 460 and occipital inner pad 18 maintain pressure on the occipital region OR of the wearer's head. In this embodiment, the rear support 460 thus comprises two biasing members 462, 464.

Figure 15:
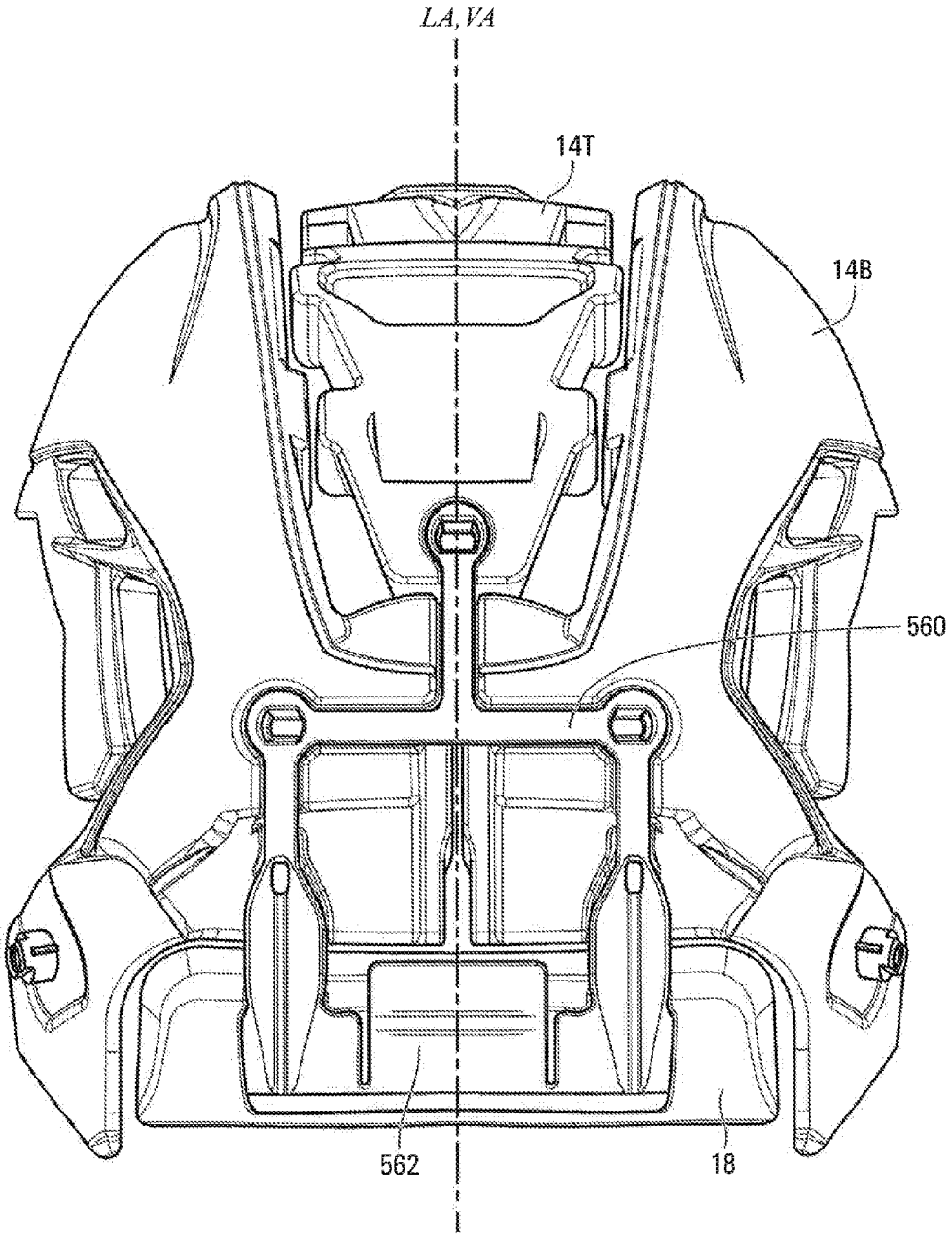
FIG. 15 is a rear view of the top inner pad, back inner pad, occipital inner pad and rear support according to a fifth embodiment of the invention.

FIG. 15 shows a rear support 560 according to a third embodiment. The rear support 560 has a central biasing members 562 extending rearwardly towards the inner surface 30 of the real shell portion 22 along an acute angle with respect to a longitudinal axis L parallel to the longitudinal axis LA and having a distal end portion abutting the inner surface 30 of the real shell portion 22, such that the rear support 560 and occipital inner pad 18 are movable between a first position wherein the rear support 560 is biased to extend inwardly from the inner surface 30 of the rear shell portion 22, and a second position when the wearer puts on the sport helmet, wherein the rear support 560 and occipital inner pad 18 are deflected towards the inner surface 30 of the rear shell portion 22 while the rear support 560 and occipital inner pad 18 maintain pressure on the occipital region OR of the wearer's head. In this embodiment, the rear support 560 thus comprises one biasing member 562.

While the biasing member shown in the drawings may take the form of an elongated leg, arm or projection, which has a proximal end portion integrally formed with the lower member of the rear support, projects rearwardly and upwardly from the lower member of the rear support towards the inner surface 30 of the real shell portion 22 and along an acute angle with respect to a longitudinal axis parallel to the longitudinal axis LA and which has a distal end portion for abutting the inner surface 30 of the real shell portion 22, such that the rear support is biased to extend inwardly from the inner surface 30 of the rear shell portion 22 in the first position, it is understood that the biasing member may alternatively be a separate or integrated spring, spring blade, C- or V-shaped member located between the inner surface 30 of the rear shell portion 22 and the rear support and/or any alternative construction providing a biasing or spring effect such that the rear support returns to its original position (i.e., first position) when pressure is no longer applied on the rear support and occipital inner pad and such that the rear support is biased to extend inwardly from the inner surface 30 of the rear shell portion 22. For example, the biasing member may comprise four springs or elongated legs made of a resilient material located equidistantly with respect to the rear support, each of the springs or legs having a proximal end portion and a distal end portion, the proximal end portion being mounted to the rear shell portion or the rear support and the distal end portion abutting the rear support or the real shell portion, such that the rear support is biased to extend inwardly from the inner surface of the rear shell portion in the first position. It is therefore understood that a skilled person in the art would design the biasing member(s) such that they are made of any suitable resilient material and have any suitable construction, shape or orientation in order that the rear support is biased to extend inwardly from the inner surface of the rear shell portion when the sport helmet is not worn by the wearer. When the wearer puts on the sport helmet, the rear support and occipital inner pad are deflected towards the inner surface of the rear shell portion while the rear support and occipital inner pad maintain pressure on the occipital region OR of the wearer's head and such that this pressure is as much as possible evenly distributed or exerted on the occipital region OR in order to avoid pressure point.

While hinging of the rear support between the first and second positions is mainly provided in part by the resiliency or bendability of the biasing member(s), it is understood that such hinging may be also provided by the bendability of the remainder of the rear support. For example, hinging of the rear support between the first and second positions may be provided in part by the bendability of the upper member 162 and left and right members 174, 176.

The above description of the embodiments should not be interpreted in a limiting manner since other variations, modifications and refinements are possible within the scope of the present invention. The scope of the invention is defined in the appended claims and their equivalents.

The invention claimed is:

1. A sport helmet for receiving a head of a wearer, the wearer's head having a crown region, a top region, left and right side regions, a back region and an occipital region, the sport helmet extending along a longitudinal axis residing within an imaginary longitudinal plan that bisects the helmet in two generally identical halves, the sport helmet comprising;

(a) an outer shell comprising a front shell portion and a rear shell portion, the rear shell portion comprising an outer surface and an inner surface;

(b) an inner padding in the outer shell, the inner padding comprising a front portion for covering at least part of the crown region and top and left and right side regions of the wearer's head and a back portion for covering at least part of the back region and top and left and right side regions of the wearer's head;

(c) an occipital inner pad located below the back portion of the inner padding for facing the occipital region of the wearer's head;

(d) a rear support comprising an upper part hingedly mounted to the back portion of the inner padding or the rear shell portion and a lower part mounted to the occipital inner pad; and (e) a biasing member between the inner surface of the rear shell portion and the rear support, the biasing member having a portion abutting the inner surface of the rear shell portion such that the rear support and occipital inner pad are movable between a first position wherein the rear support is biased, forming a gap extending inwardly from the inner surface of the rear shell portion to a portion of the biasing member, and a second position when the wearer puts on the sport helmet to cause the rear support and occipital inner pad to be deflected towards the inner surface of the rear shell portion to reduce a size of the gap while the rear support and occipital inner pad maintain pressure on the occipital region of the wearer's head.

2. A sport helmet as defined in claim 1, wherein the biasing member is made of a resilient material such that the biasing member returns to the first position when pressure is no longer applied on the rear support and occipital inner pad.

3. A sport helmet as defined in claim 1, wherein the biasing member extends upwardly and rearwardly from the lower part of the rear support and towards the inner surface of the rear shell portion.

4. A sport helmet as defined in claim 3, wherein the biasing member extends along an acute angle Θ with respect to a longitudinal axis L parallel to the longitudinal axis of the sport helmet.

5. A sport helmet as defined claim 4, wherein the acute angle Θ is between 60° and 80°.

6. A sport helmet as defined in claim 1, wherein the biasing member is made of nylon, polyacetal, polycarbonate or spring steel.

7. A sport helmet as defined in claim 6, wherein the biasing member is a left end biasing member extending upwardly and rearwardly from a left end of the lower part of the rear support and towards the inner surface of the rear shell portion, the sport helmet further comprising a right end biasing member extending upwardly and rearwardly from a right end of the lower part of the rear support and towards the inner surface of the rear shell portion.

8. A sport helmet as defined in claim 7, further comprising left and right middle biasing members extending upwardly and rearwardly from left and right middle portions of the lower part of the rear support and towards the inner surface of the rear shell portion.

9. A sport helmet as defined in claim 8, wherein the left and right end biasing members and left and right middle biasing members are left and right end elongated legs and left and right middle elongated legs integrally joined with the lower part of the rear support.

10. A sport helmet as defined in claim 1, wherein the front shell portion is a front shell member and the rear shell portion is a rear shell member, the shell members being movable relative to one another for allowing size adjustment of the sport helmet.

11. A sport helmet for receiving a head of a wearer, the wearer's head having a crown region, a top region, left and right side regions, a hack region and an occipital region, the sport helmet extending along a longitudinal axis residing within an imaginary longitudinal plan that bisects the helmet in two generally identical halves, the sport helmet comprising;

(a) an outer shell comprising a front shell portion and a rear shell portion, the rear shell portion comprising an outer surface and an inner surface;

(b) an inner padding mounted in the outer shell, the inner padding comprising a front portion for covering at least part of the crown region and top and left and right side regions of the wearer's head and a back portion for covering at least part of the back region and top and left and right side regions of the wearer's head;

(c) an occipital inner pad located below the back portion of the inner padding for facing the occipital region of the wearer's head; and (d) a rear support comprising an upper part hingedly mounted to the back portion of the inner padding or the rear shell portion and a lower part mounted to the occipital inner pad, the rear support comprising a biasing member extending towards the inner surface of the rear shell and having a portion abutting the inner surface of the rear shell portion such that the rear support and occipital inner pad are movable between a first position wherein the rear support is biased, forming a gap extending inwardly from the inner surface of the rear shell portion to a portion of the biasing member, and a second position when the wearer puts on the sport helmet to cause the rear support and occipital inner pad to be deflected towards the inner surface of the rear shell portion to reduce a size of the gap while the rear support and occipital inner pad maintain pressure on the occipital region of the wearers head.

12. A sport helmet as defined in claim 11, wherein the biasing member is made of a resilient material such that the biasing member returns to the first position when pressure is no longer applied on the rear support and occipital inner pad.

13. A sport helmet as defined in claim 11, wherein the biasing member extends upward and rearwardly from the lower part of the rear support and towards the inner surface of the rear shell portion.

14. A sport helmet as defined in claim 13, wherein the biasing member extends along an acute angle Θ with respect to a longitudinal axis L parallel to the longitudinal axis of the sport helmet.

15. A sport helmet as defined claim 14, wherein the acute angle Θ is between 60° and 80°.

16. A sport helmet as defined in claim 11, wherein the biasing member is made of nylon, polyacetal, polycarbonate or spring steel.

17. A sport helmet as defined in claim 16, wherein the biasing member is a left end biasing member extending upwardly and rearwardly from a left end of the lower part of the rear support and towards the inner surface of the rear shell portion, the sport helmet further comprising a right end biasing member extending upwardly and rearwardly from a right end of the lower part of the rear support and towards the inner surface of the rear shell portion.

18. A sport helmet as defined in claim 17, further comprising left and right middle biasing members extending upwardly and rearwardly from left and right middle portions of the lower part of the rear support and towards the inner surface of the rear shell portion.

19. A sport helmet as defined in claim 18, wherein the left and right end biasing members and left and right middle biasing members are left and right end elongated legs and left and right middle elongated legs integrally joined with the lower part of the rear support.

20. A sport helmet as defined in claim 11, wherein the front shell portion is a front shell member and the rear shell portion is a rear shell member, the shell members being movable relative to one another for allowing size adjustment of the sport helmet.

21. A sport helmet for receiving a head of a wearer, the wearer's head having a crown region, a top region, left and right side regions, a back region and an occipital region, the sport helmet extending along a longitudinal axis residing within an imaginary longitudinal plan that bisects the helmet in two generally identical halves, the sport helmet comprising:

(a) an outer shell comprising a front shell portion and a rear shell portion, the rear shell portion comprising an outer surface and an inner surface;

(b) an inner padding mounted in the outer shell, the inner padding comprising a front portion for covering at least part of the crown region and top and left and right side regions of the wearer's head and a back portion for covering at least part of the back region and top and left and right side regions of the wearer's head;

(c) an occipital inner pad located below the back portion of the inner padding for facing the occipital region of the wearer's head; and (d) a rear support comprising an upper part hingedly mounted to the back portion of the inner padding or the rear shell portion and a lower part mounted to the occipital inner pad, the rear support comprising a biasing member made of a resilient material and having a proximal end portion integrally joined with the rear support and a distal end portion, the biasing member extending towards the inner surface of the rear shell such that the distal end portion abuts the inner surface of the rear shell portion, the rear support and occipital inner pad being movable between a first position wherein the rear support is biased to extend inwardly from the inner surface of the rear shell portion, and a second position when the wearer puts on the sport helmet, wherein the rear support and occipital inner pad are deflected towards the inner surface of the rear shell portion while the rear support and occipital inner pad maintain pressure on the occipital region of the wearer's head.

22. A sport helmet as defined in claim 21, wherein the biasing member is made of nylon, polyacetal, polycarbonate or spring steel.

23. A sport helmet as defined in claim 22, wherein the biasing member extends along an acute angle Θ with respect to a longitudinal axis L parallel to the longitudinal axis of the sport helmet.

24. A sport helmet as defined claim 23, wherein the acute angle Θ is between 60° and 80°.

25. A sport helmet as defined in claim 24, wherein the biasing member is a left biasing member, the sport helmet further comprising a right biasing member made of a resilient material and having a proximal end portion integrally joined with the rear support and a distal end portion, the right biasing member extending towards the inner surface of the rear shell such that the distal end portion of the right biasing member abuts the inner surface of the rear shell portion.

26. A sport helmet as defined in claim 25, wherein the front shell portion is a front shell member and the rear shell portion is a rear shell member, the shell members being movable relative to one another for allowing size adjustment of the sport helmet.

27. A sport helmet for receiving a head of a wearer, the sport helmet comprising:

(a) an outer shell comprising a front shell portion and a rear shell portion, the rear shell portion comprising an outer surface and an inner surface;

(b) an inner padding in the outer shell, the Inner padding comprising a front portion and a back portion;

(c) an occipital inner pad located below the back portion of the inner padding for facing an occipital region of the wearer's head; and (d) a biasing member between the inner surface of the rear shell portion and the occipital inner pad, and the biasing member being free to move from a first position to a second position reducing a gap between the biasing member and the inner surface of the rear shell portion when the wearer puts on the sport helmet, wherein the biasing member being biased to press the occipital inner pad against the head of the wearer in the first and second positions.

* * * * *